United States Patent [19]

Brannan

[11] 4,234,401

[45] Nov. 18, 1980

[54] METHOD FOR RECOVERY AND USE OF ZINC FROM A LEACH SOLUTION

[75] Inventor: James R. Brannan, Perry, Ohio

[73] Assignee: Diamond Shamrock Corporation, Dallas, Tex.

[21] Appl. No.: 51,053

[22] Filed: Jun. 22, 1979

[51] Int. Cl.[3] ..... C25C 1/08; C25C 1/16; C25C 1/24

[52] U.S. Cl. ..... 204/149; 204/43 Z; 204/43 T; 204/96; 204/114; 204/130

[58] Field of Search ..... 204/96, 114, 55 R, 130, 204/149, 152, 43 Z, 43 T

[56] References Cited

U.S. PATENT DOCUMENTS

| | | | |
|---|---|---|---|
| 1,255,433 | 2/1918 | Laist et al. | 204/55 R X |
| 1,283,078 | 10/1918 | Clevenger | 204/55 R |
| 1,347,189 | 7/1920 | Stevens | 204/55 R X |
| 1,811,692 | 6/1931 | Hey et al. | 204/55 R X |
| 3,124,520 | 3/1964 | Juda | 204/55 R X |
| 3,707,448 | 12/1972 | Veloso et al. | 204/114 X |
| 3,799,850 | 3/1974 | Entshev et al. | 204/55 R X |
| 4,097,357 | 6/1978 | Jacquelin | 204/55 R X |

*Primary Examiner*—Arthur C. Prescott
*Attorney, Agent, or Firm*—John P. Hazzard

[57] ABSTRACT

This invention relates to the art of electrowinning and, more particularly, to a process for recovering zinc which is leached from an alloy coating of nickel and zinc which has previously been deposited on cathodes of an electrolytic cell used in the electrolysis of alkali metal halides. Further, a method of utilizing the recovered zinc for control of the zinc content of the nickel-zinc plating solution is disclosed.

6 Claims, 2 Drawing Figures

METHOD FOR RECOVERY AND USE OF ZINC FROM A LEACH SOLUTION

BACKGROUND OF THE INVENTION

In electrolytic processes, it has been found that the hydrogen discharge overpotential at the cathode of electrolysis cells is reduced by a coating comprising an alloy of nickel and zinc. In order to activate such coating, the alloy coated electrodes are immersed in a leach solution, commonly sodium hydroxide of moderate concentration, which removes a portion of the zinc from the alloy and leaves a nickel surface of high porosity and surface area. Patents describing this coating and leaching process include Hahndorff, U.S. Pat. No. 3,272,728, Canadian Pat. No. 955,645, and Japanese Patent Application Publication No. 6611, published Aug. 7, 1956.

U.S. Pat. No. 4,104,133 describes a process by which diaphragm cell cathode cans are coated with a nickel-zinc alloy from an electroplating solution of nickel and zinc. Anode material used in the plating process may be an alloy of nickel and zinc, an insoluble anode or, as is most common, only nickel anodes are used. The use of only nickel anodes allows for easier handling of the anode and cathode assembly, particularly when the anodes are positioned within the cathode can prior to cleaning, and the caustic cleaning solution could result in dissolution of large amounts of zinc from a combined nickel/zinc anode.

Following the plating procedure, the plated cathode can having a nickel-zinc alloy coating thereon is transferred to and immersed in a leach tank containing a solution of approximately 10 percent sodium hydroxide. Over a period of time, most of the zinc in the nickel-zinc deposit leaches out of the deposit and into solution in the leach system. It can be seen that within a short period of time following the leaching of a number of cells, a large concentration of zinc is built-up within the leach solution. In a production plating operation, as many as 20 cells per day are plated and subsequently leached producing approximately 1000 pounds of zinc in the leach solution. Such a large amount of zinc presents a critical pollution control problem as well as representing a considerable expense in metal. A process which removes zinc from the leach solution and also recovers the zinc in a form suitable for reuse within the electroplating cycle would be extremely advantageous.

It is therefore a principal object of this invention to remove leached zinc ions from the leach solution thereby avoiding the pollution problems and costs associated therewith.

It is another object of this invention to utilize recovered zinc in a process which restores the zinc concentration in the electroplating bath for the deposition of a nickel-zinc alloy onto electrolysis cell cathode cans.

Further objects and advantages of the invention will become apparent to those skilled in the art upon the reading and understanding of this specification.

SUMMARY OF THE INVENTION

In accordance with the invention, cathode cans which are plated with nickel and a leachable metal such as zinc are leached in a solution of sodium hydroxide to remove the zinc from the coating. A portion of the zinc-rich leach solution is drawn off to a separate zinc recovery tank. Insoluble anodes are located in the zinc recovery tank and a cathode substrate of zinc or an inert metal are connected to a source of direct current and zinc ions are deposited on the surface of the cathode to recover the zinc from the leach solution. The leach solution may then be recirculated to the leach tank and reused for removing additional zinc from alloy deposited cathode cans.

Further in accordance with the invention, zinc cathodes which are produced in the above-described process are transferred to a nickel recovery tank in which nickel-rich, zinc-depleted nickel-zinc plating solution is used as an electrolyte. The recovered zinc is utilized as an anode, and nickel sheeting is utilized as a cathode, the anode and cathode being connected to a source of direct current. Upon electrolyzing the solution at low current densities, nickel is deposited on the cathode and removed from the electrolyte while zinc dissolves from the anode and enriches the zinc content of the electrolyte to produce the desired nickel-zinc ion ratio for the deposition of a nickel-zinc alloy on cathode cans.

Further in accordance with the invention, zinc recovered from the leach solution as above-described may be utilized in the nickel-zinc alloy plating solution as an anode to maintain the zinc content of the nickel-zinc alloy electroplating solution.

Still further in accordance with the invention, recovered zinc may be stripped from an inert cathode substrate prior to its uilization as an anode in either a nickel recovery system or a nickel-zinc alloy plating system.

This invention allows a closed loop system for the use and recovery of zinc within a cathode coating system as described in U.S. Pat. No. 4,104,133.

BRIEF DESCRIPTION OF THE DRAWINGS

The invention is illustrated in the accompanying drawings forming a part of this specification and showing a preferred embodiment of the invention in which.

DESCRIPTION OF THE PREFERRED EMBODIMENT AND DRAWINGS

Figure 1:
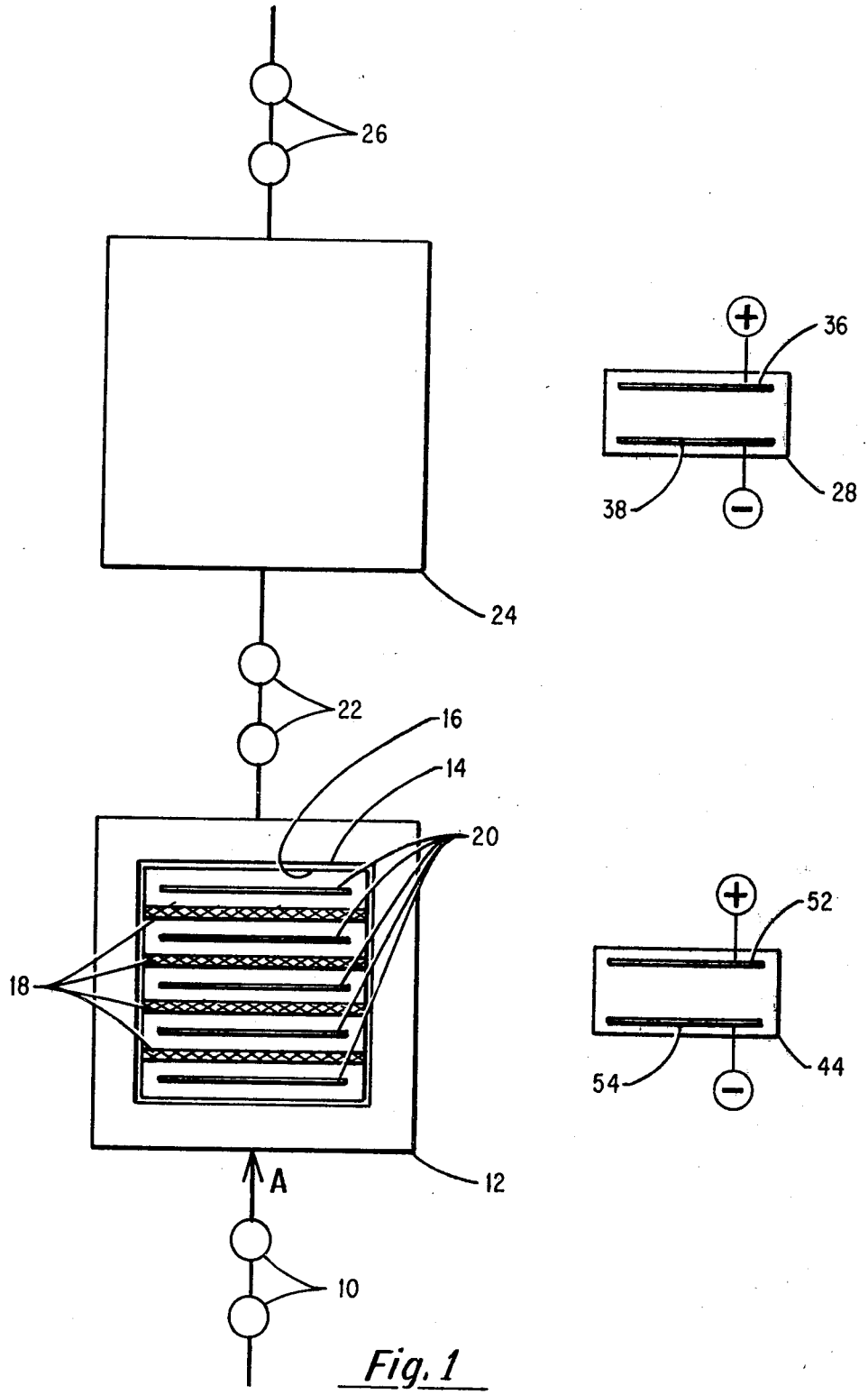
FIG. 1 is a flow diagram illustrating the cyclic recovery and reuse of zinc within the system.
Figure 2:
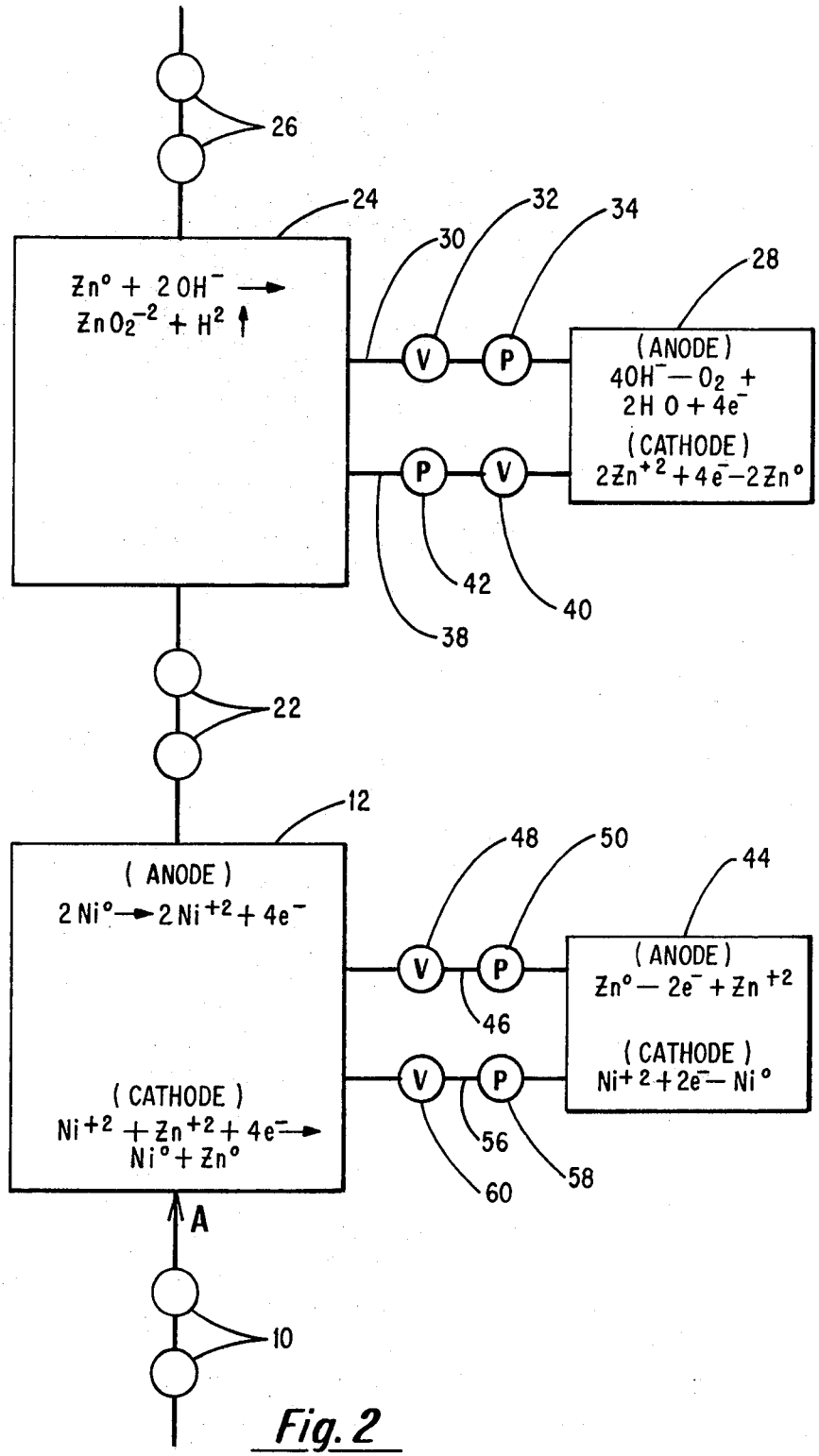
FIG. 2 is a diagram showing the flow of various solutions utilized in the process of the invention in accordance with the preferred embodiment thereof.

The invention will now be described in the more limited aspects of a preferred embodiment thereof consisting of various pieces of process equipment and a variety of process steps. It will be understood that such description of a preferred embodiment is for the purposes of illustration and not limitation and that the process of the invention shall be limited only by the scope of the appended claims.

The figures illustrate a portion of the plating line for the electro-deposition of a nickel-zinc alloy on the surface of a diaphragm-type electrolytic cell cathode can. The cathode can to be plated proceeds through a number of preplating stages 10 which may include processes such as degreasing, soaking, electrolytic cleaning, rinsing, and the like, to the plating tank 12. At that point, cathode cans 14 comprising sidewalls 16 and a plurality of parallel extending cathode tubes 18 is immersed in plating tank 12. A plurality of plating metal anodes 20 are disposed intermediate adjacent parallel cathode tubes 18 within cathode can 14 and electrical connection is made so that a nickel-zinc alloy is deposited from the electrolytic solution contained within plating tank 12 comprising generally a nickel chloride and zinc chloride acidic plating bath in accordance with the previously mentioned patent. In the figures, no electrical interconnection is shown for the purpose of avoiding confusion. However, it will be understood that plating metal anodes 20 are connected in parallel to a source of anodic direct current while cathode can 14 is connected to a source of cathodic direct current. The preferred plating metal anode material is nickel since it has been found to be advantageous to mount plating metal anodes 20 within the cell prior to beginning the production cycle and, thus, the entire cathode can 14 and anodes 20 assembly passes through the various preplating stations 10. Because of the use of alkaline cleaners and acidic pickling prior to the plating step of the process, the use of zinc anode material in plating metal anodes 20 is disadvantageous since some zinc would be dissolved in these solutions.

In plating tank 12, containing nickel ions and zinc ions, the dissolution reaction at the anode when current is applied is $$2Ni^0 \text{ yields } 2Ni^{+2}+4e^-$$

while the deposition reaction at the cathode is $$Ni^{+2}+Zn^{+2}+4e^- \text{ yields } Ni^0+Zn^0$$

It can be seen from the above reactions that zinc ions are withdrawn from the plating solution thus depleting the plating solution within tank 12 of zinc ion while at the same time, nickel ions are built-up within the plating solution.

Following the deposition of a nickel-zinc alloy deposit on cathode can 14, the cathode can 14 is withdrawn from plating tank 12 and passed through a series of post plating stations 22 which may include spray rinsing, immersion rinsing, drying and the like. Following post plating stations 22, the cathode can 14 may be stored until needed or passed directly into leach tank 24 containing a solutin of sodium hydroxide ranging from 50–400 grams per liter. Cathode can 14 having a nickel-zinc alloy applied thereto is immersed within leach tank 24 to remove a major portion of the zinc from the alloy deposit leaving a coating on the cathode tubes 18 which is comprised substantially of nickel of high surface area and porosity. Within leach tank 24, the following dissolution reaction takes place:

$$Zn^0+2OH^- \text{ yields } ZnO_2^{-2}+H_2$$

Leaching of cathode can 14 within leach tank 24 takes a considerably longer time than plating of a cathode can 14 within plating tank 12 and, thus, a continuous process is not possible unless leach tank 24 is sized so as to accept a plurality of cathode cans 14 at various stages of leaching at any one time although such sizing and flow of production is not relavent to the present invention.

Following the leaching of cathode can 14, the cathode can 14 passes through a number of post leaching stations 26 which may include various rinse tanks and driers.

It can be seen that zinc ions build up quickly within the leach solution in leach tank 24. Rather than periodically dump the depleted leach solution containing large amounts of dissolved zinc, it is contemplated within the scope of this invention to periodically or continuously remove a portion of the leach solution containing relatively high concentrations of zinc ion to a remote tank 28 illustrated in the figures. This may be accomplished by removing solution from leach tank 24 through conduit 30 having valve 32 and pump 34 disposed therealong emptying into remote zinc recovery tank 28. Within zinc recovery tank 28 is disposed at least one anode of preferrably nickel or of an inert material such as lead or an anode of the dimensionally stable type comprising a substrate of valve metal having an electrocatalytic conductive coating thereon comprised of precious metals, oxides of precious metals, transition metals, oxides of transition metals or combinations of precious metals and transition metals and/or their oxides. A cathode substrate material comprising stainless steel, passivated nickel, titanium or the like is also disposed within the zinc recovery tank 28 and parallel to anode member 36. Upon the application of current to anode member 36 and cathode member 38, zinc ions within the leach solution are deposited on the surface of the cathode 38 as powdered or solid zinc. The cathode reaction at the surface of cathode 38 is $$2Zn^{+2}+4e^- \text{ yields } 2Zn^0$$

while the anode reaction occurring at the surface of anode 36 is $$4OH^- \text{ yields } 2O_2+4e^-+2H_2O$$

The solution from zinc recovery tank 28 may then be either batchwise or continuously returned to leach tank 24 through conduit 38 having valve 40 and pump 42 disposed therealong.

Alternatively, the zinc-depleted leach solution may be neutralized and dumped as economics dictate. This is particularly true if an additive facilitating the deposition of zinc on cathode member 38 is utilized. Typical additives may include agar, molasses, or any of various proprietary non-cyanide alkaline zinc plating additives. It will be understood, however, that if such additives will have no effect upon the leach system, the zinc-depleted leach solution from zinc recovery tank 28 may be returned with such additives to leach tank 24.

Metallic zinc is deposited on the surface of the cathode 38 as a continuous layer covering the surface of the substrate mterial. Alternatively, portions of the substrate may be masked off such as in a perforated manner with a dielectric material so that "rounds" of metallic zinc are deposited on the surface of the cathode.

The metallic zinc recovered from the leach solution may then be disposed of in a proper manner or sold as scrap or, alternatively, as contemplated within the scope of this invention, the recovered metallic zinc may be utilized as anode material in a nickel recovery process to be described hereinafter.

As previously stated, the plating solution within plating tank 12 utilizes nickel as anode material. When nickel and zinc ions are deposited on the surface of the cathode can 14, there is a consequent build up of nickel ions and a depletion of zinc ions within the solution as seen in the previously mentioned electrode reactions.

In accordance with the invention, a portion of this nickel-rich, zinc-depleted plating solution may be withdrawn from plating tank 12 to nickel recovery tank 44 through conduit 46 attached therebetween having valve 48 and pump 50 disposed therealong. Within nickel recovery tank 44 are disposed anode 52 which is preferably zinc or inert metal covered with zinc, such zinc being the product of the zinc recovery process previously described and a cathode substrate which may comprise either a nickel sheet or a passivated surface such as passivated nickel, stainless steel, or titanium so that the nickel deposited thereon by the application of current may be removed and reused as a plating metal anode 20 in the nickel-zinc plating tank 12.

Bath conditions are controlled within nickel recovery tank 44 so that the cathode deposit formed on cathode substrate 54 is comprised almost entirely of nickel although some zinc contamination of the deposit is possible but not detrimental to the invention. The use of higher plating temperatures in the range of 60°-82° C. and low current densities in the range of 0.1-0.2 amperes per square inch will insure that the cathode deposit from the nickel recovery system is primarily nickel. The electrode reaction at the surface of anode 52 is $$Zn^{O} \text{ yields } Zn^{+2}+2e^{-}$$

while the predominant cathode reaction is $$Ni^{+2}+2e^{-} \text{ yields } Ni^{0}$$

It can be seen from the above reactions that nickel is removed from the nickel-rich, zinc-depleted plating solution while zinc is built-up within the plating solution returning it to the optimum concentration of both nickel and zinc for deposition of the correct proportion of nickel and zinc in the alloy deposited within the plating tank 12.

The thus properly balanced plating solution may then be returned through conduit 56 extending between nickel recovery tank 44 and plating tank 12 and having pump 58 and valve 60 disposed therealong in either a continuous or batchwise manner.

It can thus be seen that the plating, leaching, zinc recovery and nickel recovery as above-described delineates a closed loop system wherein zinc is continually utilized for deposit and plating bath control thereby substantially reducing the cost of the plating system by avoiding the need for a dilution or other similar method to control nickel build up and eliminating pollution control problems associated with the disposal of zinc from a leach tank system.

The following examples will serve to illustrate the utilization of both the zinc recovery and the nickel recovery systems as contemplated within the scope of the invention. Such examples should not be construed in any way as a limitation upon the invention but only as illustrative of the concepts associated with the preferred embodiment thereof.

EXAMPLE 1

A titanium cathode substrate was cleaned in a hot (100° C. ) solution of HCl for 15 minutes. The titanium cathode substrate was then immersed in an aqueous solution of about 100 grams per liter sodium hydroxide and about 10 grams per liter zinc oxide. A dimensionally stable anode comprising a titanium substrate having an electroconductive coating of precious metal and valve metal oxides thereon was also immersed in the described solution. The anode and cathode were connected to a source of direct current and plated for 3 hours at a temperature of about 45° C. and a current density of about 0.2 amperes per square inch of cathode area. Approximately one-half gram per square inch of cathode area of dull gray zinc was deposited on the cathode during this period.

EXAMPLE 2

To an aqueous solution similar to the above, 3 grams per liter agar was added. Under similar plating conditions, at 45° C., and 0.15 amperes per square inch, a smooth semibright zinc deposit was obtained.

EXAMPLE 3

In an aqueous solution similar to that of Example 2, a cathode was plated at 0.05 amperes per square inch and 35° C. for 1.5 hours. A smooth, uniform deposit of zinc was obtained.

EXAMPLE 4

To the solution composition of Example 1, 3 milliliters of molasses per liter of solution was added. A cathode was plated at 0.2 amperes per square inch and 35° C. for 1.5 hours. A smooth, semibright zinc deposit was obtained.

EXAMPLE 5

A nickel-rich, zinc-depleted plating solution from a nickel-zinc alloy plating bath containing about 62 grams per liter nickel and about 20 grams per liter zinc at a pH of approximately 3.6 was transferred to a separate plating tank. Zinc anode material was immersed in the plating solution, and a cleaned and activated nickel sheet was similarly immersed as a cathode. The zinc anode and nickel cathode were electrically connected to a source of direct current, and the cathode was plated at a current density of about 0.1 to about 0.2 amperes per square inch at 70° C. Under these conditions, the deposit on the cathode contained 85 percent nickel and 15 percent zinc. The concentration of the plating solution after approximately 2 hours was about 60 grams per liter nickel and about 23 grams per liter zinc. The nickel recovered from this system may be utilized as an anode in the alloy plating system, and the zinc enriched plating solution may be recycled to the alloy plating bath for deposition of a nickel-zinc alloy.

While the invention has been described in the more limited aspects of preferred embodiments thereof, other embodiments have been suggested and still others will occur to those skilled in the art upon the reading and understanding of the foregoing specification. It is intended that all such embodiments be included within the scope of the appended claims.

What is claimed is:

1. In a process for the deposition of an active nickel-zinc alloy coating on cathode substrates to be utilized in electrolytic processes wherein a nickel-zinc alloy is electrodeposited on said cathode from a plating solution containing nickel ions and zinc ions and utilizing a nickel anode followed by the leaching of the zinc component of the alloy deposit into a solution of 50-400 grams per liter sodium hydroxide, a process for the recovery of zinc from the leach solution comprising the steps of:

transferring a portion of the leach solution to a remote tank;

immersing a cathode substrate in said leach solution in said remote tank;

immersing an insoluble anode in said leach solution in said remote tank;

electrically connecting said anode and said cathode to a source of direct current and electrolyzing said leach solution, and removing zinc metal deposited on said cathode from said remote tank.

2. The method as described in claim 1 wherein said step of electrolyzing is carried out at a current density of about 0.05 to about 0.2 amperes per square inch of cathode area.

3. The method as described in claim 1 further including the steps of returning said leach solution following the step of deposition to said leach tank.

4. The method as described in claim 1 further including the steps of mechanically removing said metallic zinc from said cathode substrate.

5. The method as described in claim 2 wherein said leach solution is continually circulated between said leach tank and said remote tank.

6. The method as described in claim 1 wherein said zinc metal is utilized in a process for recovering zinc and building up zinc ions within a nickel-rich, zinc-depleted plating solution from said plating tank comprising the additional steps of immersing said zinc metal and a cathode substrate in said nickel-rich, zinc-depleted plating solution;

electrically connecting said zinc metal and said cathode substrate to a source of direct current to deposit a nickel-rich coating on said cathode substrate at about 0.1 to about 0.2 amperes per square inch of cathode area at about 60°–82° C.

* * * * *